US005085610A

United States Patent [19]

Engel et al.

[11] Patent Number: 5,085,610

[45] Date of Patent: Feb. 4, 1992

[54] DUAL SOUND TOY TRAIN SET

[75] Inventors: Robert W. Engel, Thousand Oaks; Joseph W. Franke, Van Nuys; Alex R. Piyevsky, Reseda; Enis J. Unalp, Claremont, all of Calif.

[73] Assignee: Mattel, Inc., El Segundo, Calif.

[21] Appl. No.: 700,834

[22] Filed: May 16, 1991

[51] Int. Cl.[5] ..... A63H 19/10; A63H 30/00

[52] U.S. Cl. ..... 446/175; 446/447

[58] Field of Search ..... 446/175, 193, 446, 447, 446/467; 104/DIG. 1

[56] References Cited

U.S. PATENT DOCUMENTS

| | | | |
|---|---|---|---|
| 2,974,441 | 3/1961 | Denner | 446/175 |
| 2,995,866 | 8/1961 | Johnson | 446/175 |
| 3,192,460 | 6/1965 | Wolff et al. . | |
| 3,961,441 | 6/1976 | Sato | 446/175 |
| 4,085,542 | 4/1978 | Mitamura | 446/175 |
| 4,086,724 | 5/1978 | McCaslin | 446/175 |
| 4,165,581 | 8/1979 | Wolf | 446/175 |
| 4,973,286 | 11/1990 | Davison | 446/175 |

*Primary Examiner*—Mickey Yu
*Attorney, Agent, or Firm*—Roy A. Ekstrand

[57] ABSTRACT

A dual sound toy train set includes a toy track formed in a continuous loop and having guiding rails on either side thereof. An electrically powered toy train engine is coupled to the track and includes an internal battery power source, an electric drive motor and a motor control unit. An ultrasonic microphone is supported upon the toy train engine and operatively coupled to the motor control unit. A sound unit includes a housing supporting a pair of air bellows having one way inlet valves attached thereto. A movable pump handle is operative to collapse the air bellows and produce pressurized air streams which are coupled by hollow tubes to an ultrasound whistle and an audible sound whistle. The audible sound whistle produces exciting play sounds similar to those produced by conventional locomotives. The ultrasonic energy produced by the ultrasound whistle is received by the microphone on the toy train engine and is used to alternately energize and deenergize the electric drive of the toy train to start and stop the toy train.

10 Claims, 3 Drawing Sheets

DUAL SOUND TOY TRAIN SET

FIELD OF THE INVENTION

This invention relates generally to powered toys and particularly to those operative upon track systems.

BACKGROUND OF THE INVENTION

The advent of inexpensive small electric motors has brought forth a great variety of interesting and exciting toys which are electrically powered. Such toys exhibit a variety of shapes and configurations typically including miniature cars, trucks, trains, airplanes and the like. Two basic types of power propulsion apparatus are provided to cooperate with a small electric motor within the vehicle drive system. In the first type, one or more battery power sources are supported within the powered toy and provide energy for a period of time to operate the electric motor. In others, an external power source is provided and some means such as a track rail and conductive brush mechanism are employed to couple the external power source to the internal motor of the powered toy.

An interesting variation of the powered toys are found in various apparatus for remotely controlling the powered toys. The expense and complexity of such remotely controlled powered toys ranges from the relatively high technology complex radio control systems to infrared coupled systems to the least expensive and least complex which respond to sound energy.

U.S. Pat. No. 3,961,441 issued to Sato sets forth a SONIC RESPONSIVE TOY VEHICLE STEERING SYSTEM in which a toy vehicle chassis supports a battery powered electric propulsion system and an electrically powered steering system operative upon the front wheel. A handheld sound wave generating unit remote from the vehicle cooperates with a sonic transducer within the vehicle for translating sound waves generated by the handheld unit to electrical signals for controlling the steering mechanism of the vehicle. The sound system is capable of distinguishing between a variety of sound signals.

U.S. Pat. No. 4,085,542 issued to Mitamura sets forth a SONIC RESPONSIVE TOY VEHICLE STEERING SYSTEM in which a toy vehicle includes a chassis, a propulsion and guidance wheel mounted on the chassis to propel the vehicle along a surface and provide steering of the vehicle. A sound wave responsive control system is operative within the vehicle and responds to sounds produced by a remote handheld unit for operating the vehicle propulsion and steering system.

U.S. Pat. No. 2,995,866 issued to Johnson sets forth a SOUND ACTUATED TOY which resembles a truck or similar vehicle having a front wheel assembly capable of three hundred and sixty degree rotation in one direction only. A motor drive system is coupled to the front wheel assembly to affect steering of the toy vehicle. A control mechanism is connected to the drive system and includes a sound switch for response to an externally produced sound.

U.S. Pat. No. 4,086,724 issued to McCaslin sets forth a MOTORIZED TOY VEHICLE HAVING IMPROVED CONTROL MEANS in which a toy vehicle includes a chassis and body assembly. A battery powered electric motor drive is coupled to the vehicle rear wheels to propel the vehicle. A second electric motor is coupled to a vehicle steering mechanism which in turn is coupled to a fifth steering wheel extending downwardly from the chassis underside. A control circuit and microphone cooperate to transform externally produced sound commands to appropriate electrical signals to orient the steering wheel through activation of its motor control to affect sound responsive vehicle steering.

U.S. Pat. No. 3,192,460 issued to Wolff, et al. sets forth a REVERSIBLE DC MOTOR WITH AXIALLY SHIFTABLE ROTOR in which a remote control system includes a DC motor having an output control transistor to supply motor power. The motor armature is arranged to moved axially by magnetic action when energized to center the armature in the energizing field and reduce the amount of power required.

U.S. Pat. No. 4,165,581 issued to Wolf sets forth a SOUND CONTROLLED VEHICLE in which a toy vehicle includes a electric motor propulsion system for moving the vehicle. A turning mechanism within the vehicle responds to remote sound or radio frequency transmissions to perform the turning function. The turning system utilizes a linkage system as well as a motor driven disk having an electrically conductive pattern thereon for providing vehicle control. Electric means within the control system cooperate with the conductive pattern.

U.S. Pat. No. 2,974,441 issued to Denner sets forth a SYSTEM FOR THE REMOTE CONTROL OF TOYS in which a toy vehicle includes an electrically powered drive mechanism together with a pair of steerable front wheels. The steerable front wheels are coupled to an eccentric pin on a rotatable steering disk by an elongated slotted member. The rotation of the steering disk produces angular change of the steering wheels as it rotates and an electrically driven escapement mechanism is coupled to the steering disk and operates under electric control for incrementally turning the steering disk in either direction.

While the foregoing described prior art representative devices have generally provided amusing and entertaining toy vehicle systems, their control systems are generally complex and expensive to manufacture. In addition, the operation of the prior art remote controlled systems are usually difficult for operation by younger children. Accordingly, there remains a continuing need in the art for evermore interesting and exciting remote controlled toys. There remains a particular need for such exciting remote controlled toys which may be easily operated by younger children.

SUMMARY OF THE INVENTION

Accordingly, it is a general object of the present invention to provide an improved remote controlled toy. It is a more particular object of the present invention to provide an improved remote controlled toy which provides additional excitement and play value and which may be operated by younger children.

In accordance with the present invention, there is provided a dual sound toy comprises: a track; a toy vehicle movable on the track having battery-powered propulsion means; control means responsive to a first inaudible sound frequency within the toy for causing the propulsion means to alternate between operative or inoperative states each time the first sound energy is received; and sound means for simultaneously producing sound energy at the first sound frequency and sound energy at a second audible sound frequency.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
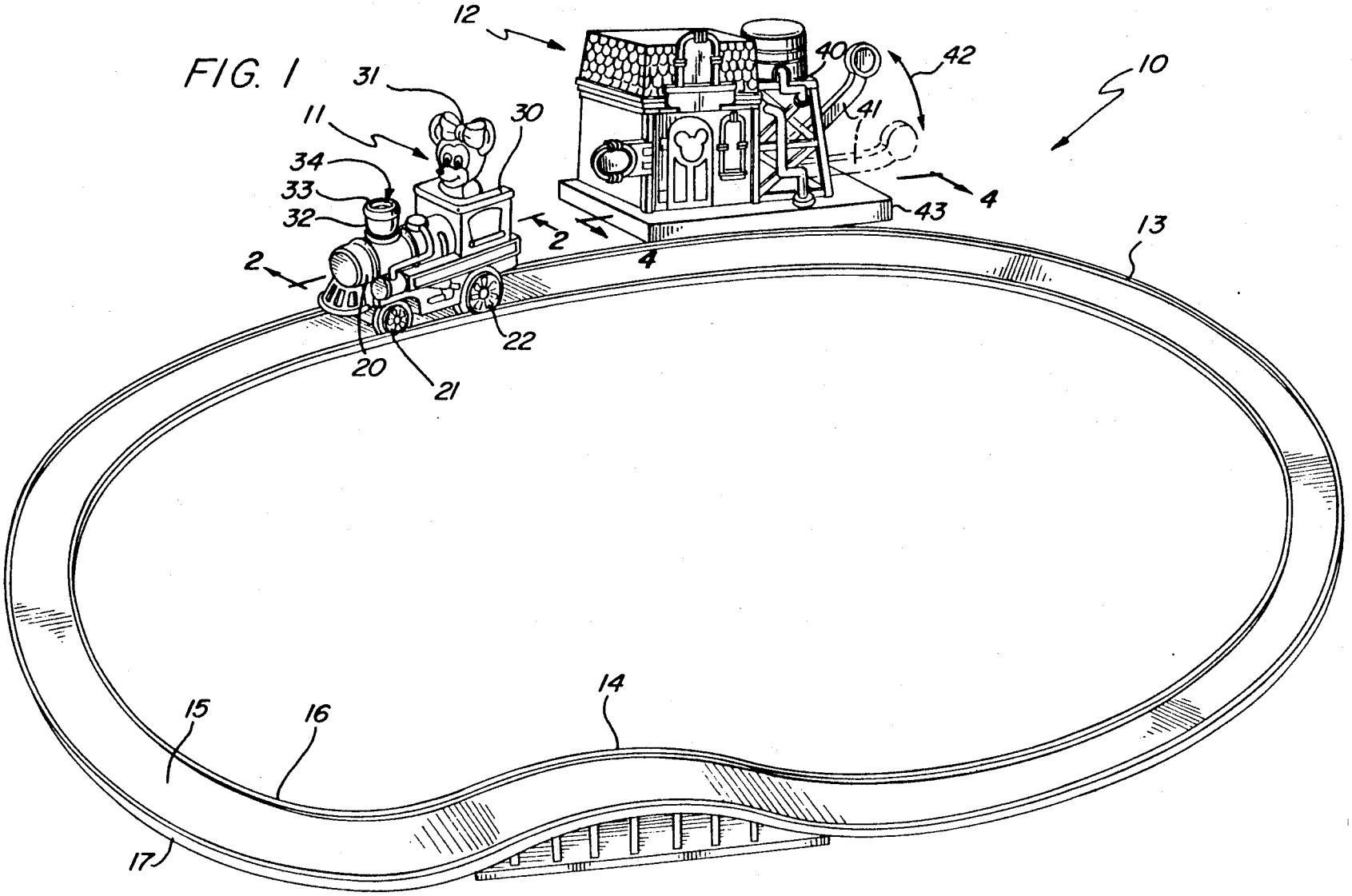
FIG. 1 sets forth a perspective view of a dual sound toy train set constructed in accordance with the present invention.

FIG. 1 sets forth a perspective view of a dual sound toy train set constructed in accordance with the present invention and generally referenced by numeral 10. Train set 10 includes a closed track loop 13 constructed in accordance with conventional fabrication techniques having a raised bridge portion 14. A toy train engine 11, the structure of which is set forth below in greater detail, includes a hollow body 20 configured to replicate a fanciful train locomotive. A quartet of support and drive wheels 21, 22, 23 and 24 (the latter seen in FIG. 3) are rotatably supported upon body 20 by means set forth below in greater detail. The position and configuration of wheels 21 through 24 is selected to correspond to and cooperate with track 13 such that toy train engine 11 may be propelled about track 13 in a nonsteering operation. Accordingly, track 13 includes a flat center portion 15 and a pair of raised side rails 16 and 17. Locomotive body 20 further defines an upwardly extending cab 30 having a fanciful depiction of a driver 31 shown supported therein. Body 20 further defines an upwardly extending generally cylindrical smokestack 32 defining an interior recess 33. As is better seen in FIG. 2, smokestack 32 supports an ultrasonic microphone 34.

Sound unit 12 includes a housing 40 supported upon an integral base 43. Housing 40 is preferably formed of a molded plastic material or the like and defines an interior cavity (better seen in FIGS. 4 and 5). Housing 40 may be configured in any number of aesthetic choices. In the embodiment shown in FIG. 1, housing 40 is a fanciful replication of a train station and water stop. A pump handle 41 is pivotally secured to housing 40 by means set forth below in greater detail and is pivotally movable in the direction of arrows 42 between the solid line and dashed line representations shown in FIG. 1.

The internal structure of train engine 11 is set forth below in greater detail in FIGS. 2 and 3. However, suffice it to note here that train engine 11 supports an internal battery powered electric motor drive coupled to rear wheels 22 and 24. Train engine 11 further supports a motor control system which is coupled to microphone 34 and responds to sound energy received by microphone 34 to control the application of power to wheels 22 and 24. In its preferred form, train engine 11 is controlled to respond each time ultrasound energy is received by microphone 34 to alternately energize and deenergize the motor drive mechanism coupled to wheels 22 and 24.

Figure 4:
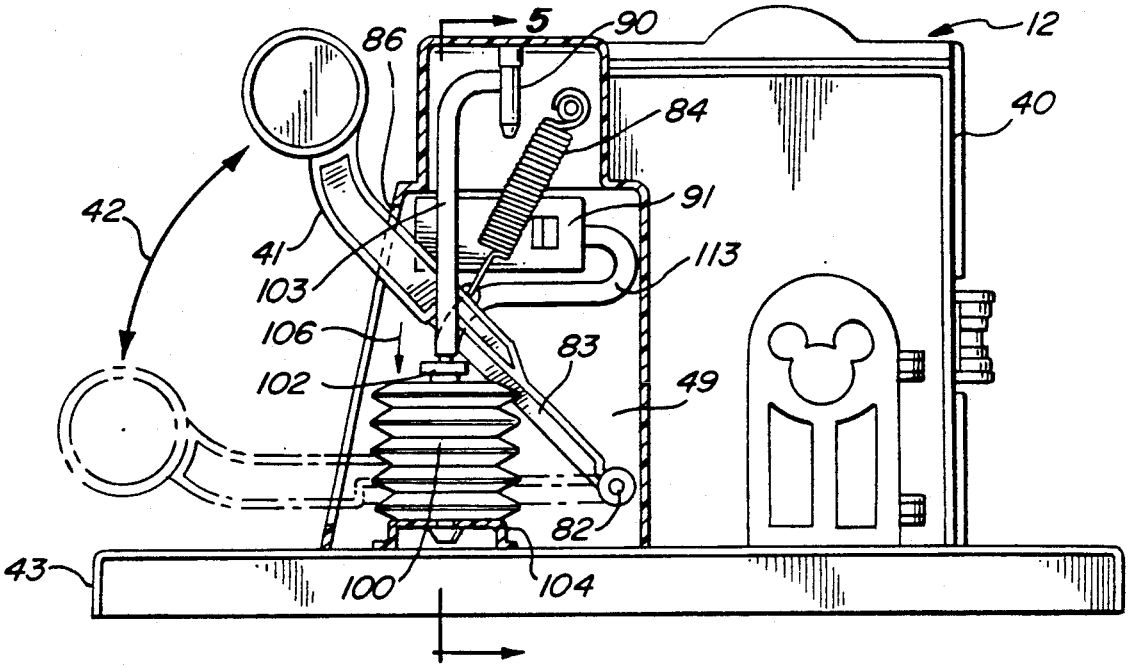
FIG. 4 sets forth a section view of the sound producing portion of the present invention toy train set taken along section lines 4—4 in FIG. 1.
Figure 5:
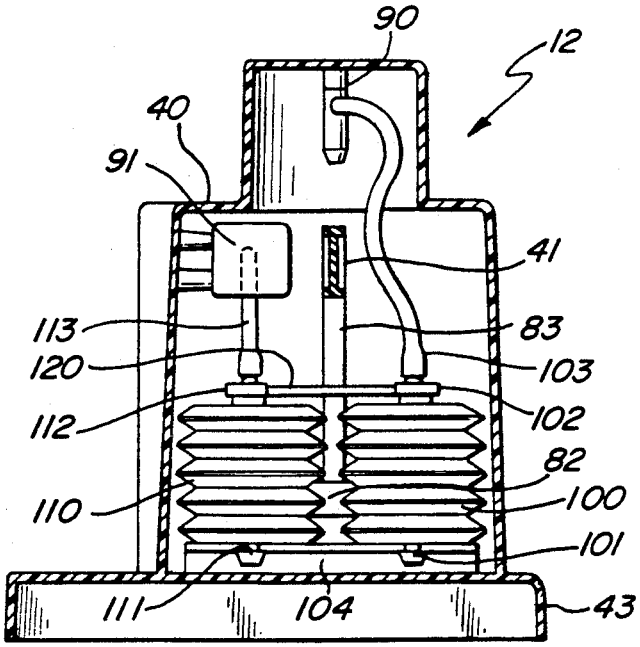
FIG. 5 sets forth a section view of sound producing portion of the present invention toy train set taken along section lines 5—5 in FIG. 4.

The operative mechanism of sound unit 12 is further described in FIGS. 4 and 5. However, suffice it to note here that sound unit 12 includes a pair of sound producing units which are operatively coupled to pump handle 41 such that actuation of pump handle 41 from the raised position shown in FIG. 1 to the lowered position shown in dashed line representation produces simultaneous audible train whistle sounds and ultrasound energy.

In operation, the user applies a downward force to handle 41 which, by means set forth below, is spring-biased to its raised position. The downward force upon handle 41 simultaneously produces ultrasound energy which is received by microphone 34 within train engine 11 and an exciting audible sound which simulates the typical locomotive train whistle. Each time handle 41 is cycled through a downward stroke, the simultaneous production of audible and ultrasound energy is produced. Once handle 41 is released, the spring mechanism within housing 40 restores handle 41 to the raised position. Each burst of ultrasound energy received by microphone 34 causes train engine 11 to alternate between on and off motor powered conditions. As a result, each time handle 41 is pumped downwardly, train engine 11 is switched from its current operative position to the alternate position in an on/off alternation. Thus, if handle 41 is pressed while train engine 11 is stopped, the control mechanism within train engine 11 energizes the motor drive system and drives train engine 11 forwardly upon track 13. Conversely, if pump handle 41 is pressed downwardly at a time when train engine 11 is energized and moving forwardly upon track 13, the forward motion of train engine 11 ceases and it stops until the next time pump handle 41 is again pushed downwardly. As a result, the young child user of toy train set 10 may easily control the operation of train engine 11 by simply manipulating pump handle 41. In addition, the simultaneous use of audible sound producing mechanisms together with ultrasound control mechanisms permits an exciting whistle sound to be enjoyed by the user while providing the reliability of an ultrasound system.

It will be apparent to those skilled in the art that, in its anticipated use, toy train set 10 would further include a plurality of simulated train cars which would be coupled to and pulled by train engine 11 around track 13. For purposes of illustration, however, such passive toy train cars have been omitted from FIG. 1.

Figure 2:
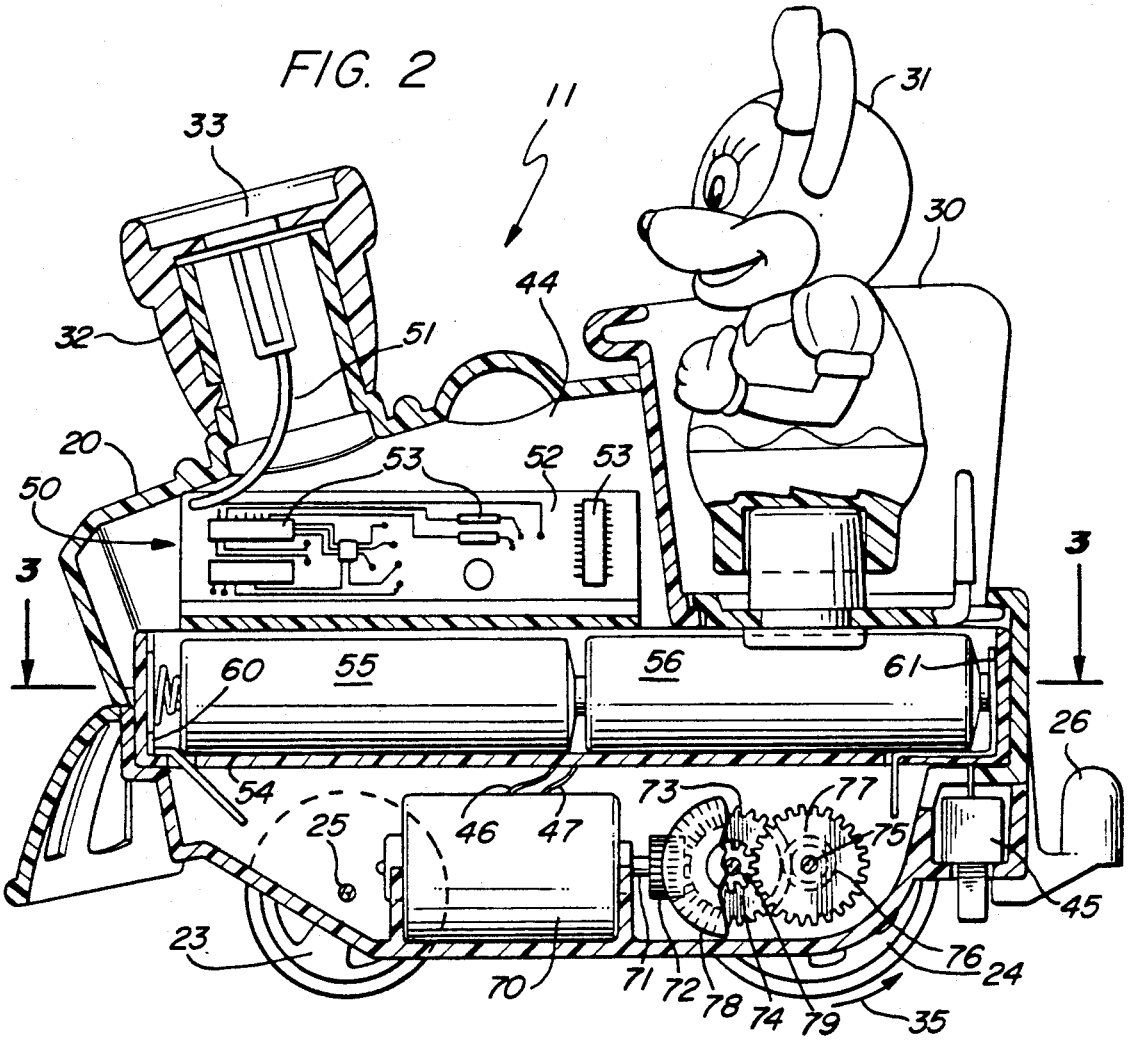
FIG. 2 sets forth a section view of the train engine of the present invention dual sound toy train set taken along section lines 2—2 in FIG. 1.

FIG. 2 sets forth a section view of toy train engine 11 taken along section lines 2—2 in FIG. 1. Toy train engine 11 includes a hollow body 20 preferably formed of a molded plastic material or the like. As mentioned above, body 20 is supported by a plurality of rotatable wheels 21 through 24 of which wheels 23 and 24 are seen in FIG. 2. Body 20 further defines an upwardly extending generally cylindrical smokestack 32 having a recess 33 defined therein. An ultrasonic microphone 34 is supported within recess 33 and smokestack 32. Body 20 further defines an upwardly extending cab portion 30 which in turn supports a fanciful representation of a driver 31. A coupler 26 constructed in accordance with conventional fabrication techniques is formed in the rear portion of body 20 and is utilized to provide coupling to a passive toy railroad car to be pulled by train engine 11 (not shown). Body 20 further defines an interior cavity 44 having a battery support 54 disposed therein. Battery support 54 is constructed in accordance with conventional fabrication techniques and includes a pair of electrical contacts 60 and 61 disposed at opposite ends of support 54. A pair of conventional batteries 55 and 56 are received within battery support 54 and electrically coupled to contacts 60 and 61. An on/off switch 45 is supported within body 20 and operatively coupled to contact 61 to provide for interruption of electrical coupling to batteries 55 and 56 during periods of nonuse. An electrical control unit 50, constructed in accordance with conventional fabrication techniques, includes a printed circuit board 52 supporting a plurality of electronic circuit components 53. A connection 51 couples control unit 50 to ultrasonic microphone 34. A drive motor 70 comprising a conventional single direction electric drive motor is coupled to control unit 50 by a pair of connecting wires 46 and 47. Motor 70 includes an extending output shaft 71 having a drive gear 72 secured thereto. A gear drive unit includes a plurality of gears 72, 73, 74, 76 and 77 which couples output shaft 71 of motor 70 to a transversely extending rear axle 75. Rear axle 75 is secured to gears 77 and 76 and supports rear wheels 24 and 22 (the latter seen in FIG. 1). In accordance with conventional fabrication techniques, the energizing of motor 70 causes output shaft 71 to rotate which in turn rotates gear 72 driving gears 78 and gears 73 and 74. The rotation of gears 73 and 74 drives gears 76 and 77 rotating axle shaft 75 causing wheel 24 (and wheel 22) to rotate in the direction of arrow 35 which in turn propels toy train engine 11 forwardly.

Control unit 50 is constructed in accordance with conventional fabrication techniques and is operative as a toggle circuit which alternately couples batteries 55 and 56 to motor 70 and decouples motor 70 from batteries 55 and 56 in response to each burst of ultrasound energy received by microphone 34.

Figure 3:
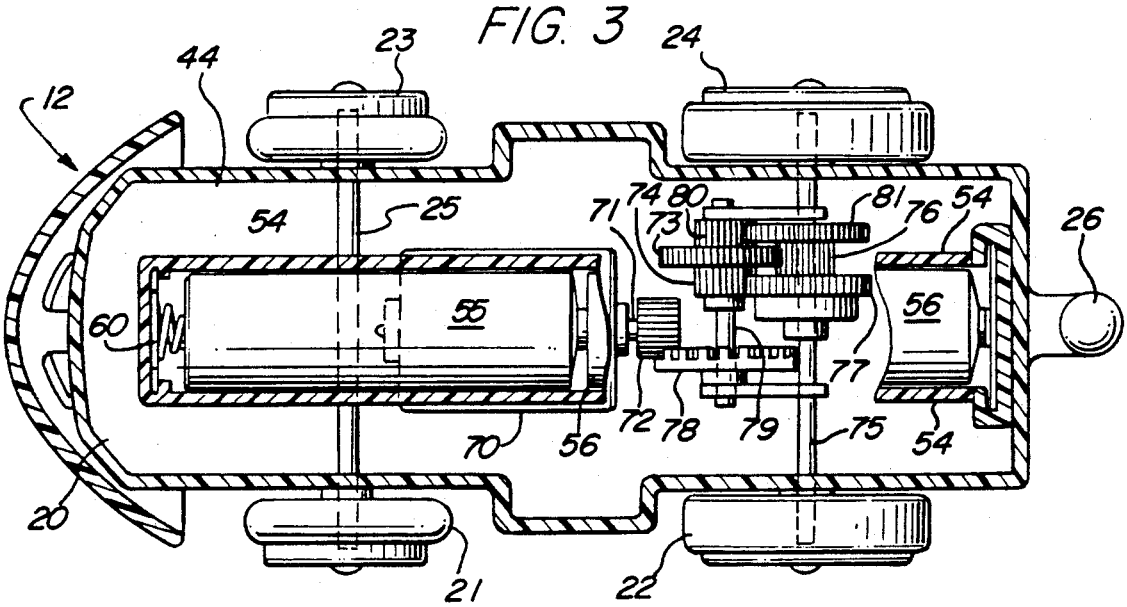
FIG. 3 sets forth a section view of the toy train engine of the present invention taken along section lines 3—3 in FIG. 2.

FIG. 3 sets forth a section view of toy train engine 11 taken along section lines 3—3 in FIG. 2. As described above, toy train 11 includes a hollow body 20 supported by a pair of front wheels 21 and 23 and a pair of rear wheels 22 and 24. An axle 25 extends through body 20 and supports front wheels 21 and 23 in a freely rolling attachment. A rear axle 75 extends through body 20 and supports rear wheels 22 and 24. Axle 75 further supports a plurality of attached gears 76, 77 and 81. A motor 70 is supported within interior cavity 44 of body 20 and includes an output shaft 71 coupled to a drive gear 72. A shaft 79 supports a driven gear 78 and is secured to a plurality of gears 73, 74 and 80. Gears 73, 74 and 80 are coupled to gears 76, 77 and 81 respectively to provide a direct power coupling between output shaft 71 of motor 70 and axle 75 and wheels 22 and 24.

Body 20 further defines an extending coupler 26 and an interior battery support 54. A pair of batteries 55 and 56 are received within battery support 54 and form electrical connections to a pair of electrical contacts 60 and 61 within battery support 54.

In operation, the energizing of motor 70 in response to ultrasonic energy by microphone 34 and processed by control unit 50 (seen in FIG. 2) rotates output shaft 71 and gear 72. The rotation of gear 72 is coupled through gears 78, 73, 74, 80, 76, 77 and 81 to rotate axle shaft 75 and rear wheels 22 and 24.

FIG. 4 sets forth a section view of sound unit 12 taken along section lines 4—4 in FIG. 1. Sound unit 12 includes a housing 40 defining an interior cavity 49 and a vertical slot 48. A base 43 is secured to housing 40 and supports housing 40 upon a play surface or the like. A pedestal 104 is formed upon base 43 and extends transversely across base 43 within interior cavity 49. A pair of collapsible air bellows 100 and 110 (the latter seen in FIG. 5) are secured to and supported by pedestal 104. Air bellows 100 include an inlet valve 101 at its lower end and an outlet 102 on its upper end. Outlet 102 is coupled to an ultrasonic whistle 90 by a hollow tube 103. As is better seen with temporary reference to FIG. 5, air bellows 110 includes an inlet valve 111 and an outlet 112. A tube 113 couples outlet 112 to audible whistle 91. Returning to FIG. 4, a pump handle 41 is pivotally secured at one end within interior cavity 49 by a pivot 82. Pump handle 41 extends outwardly from cavity 49 through slot 48. A spring 83 is coupled to a post 84 formed in housing 40 and to pump handle 41. Spring 83 urges handle 41 upwardly against the upper edge 86 of slot 48. Spring 83 biases or maintains handle 41 in the raised position shown in solid line depiction in FIG. 4. As is better seen in FIG. 5, outlets 102 and 112 of air bellows 100 and 110 respectively are commonly linked by a linking arm 120. Linking arm 120 cooperates with handle 41 to simultaneously depress and collapse air bellows 100 and 110 as pump handle 41 is pivoted downwardly in the direction indicated by arrow 106. The simultaneous collapse of air bellows 100 and 110 produces compression of the air within bellows 100 and 110 causing inlet valves 101 and 111 to be simultaneously closed. The further collapse of bellows 100 and 110 produces pressurized air streams which flow upwardly through tubes 103 and 113 respectively. The air driven upwardly through tube 103 is converted by ultrasonic whistle 90 to ultrasound energy which is received by microphone 34 (seen in FIG. 2). Conversely, the air stream produced in tube 113 is converted by audible whistle 91 to an audible sound similar to that produced by conventional locomotives. Upon the release of pump handle 41, the spring force of spring 83 returns pump handle 41 to the raised position shown in FIG. 4. Thus, sound unit 12 is operated by forcing handle 41 downwardly in the direction indicated by arrow 106 to the dashed line position shown in FIG. 4. Thereafter, handle 41 is released. With each downward stroke of pump handle 41, a pressurized stream of air is produced in tubes 103 and 113 causing the simultaneous production of ultrasound acoustic energy and audible sound energy. With each release of pump handle 41, the resilient force of air bellows 100 and 110 causes them to expand and return to the positions shown in FIGS. 4 and 5. The expansion of air bellows 100 and 110 as they return from the collapsed position to the extended position actuates inlet valves 101 and 111 causing bellows 100 and 110 to draw a fresh quantity of air into the bellows interiors.

FIG. 5 sets forth a section view of sound unit 12 taken along section lines 5—5 in FIG. 4. Sound unit 12 includes a housing 40 defining an interior cavity 49 and a base 43. Base 43 supports a pedestal 104 within interior cavity 49. As described above, a pump handle 41 defining a channel 83 is pivotally secured within interior cavity 49. An air bellows 100 is supported upon pedestal 104 and includes a inlet valve 101 and an outlet 102. Air bellows 110 is supported upon pedestal 104 and includes an inlet valve 111 and an outlet 112. A linking arm 120 is coupled between outlets 102 and 112 to provide mechanical coupling therebetween. A tube 103 couples outlet 102 of bellows 100 to an ultrasonic whistle 90. Similarly, a tube 113 couples outlet 112 of air bellows 110 to an audible whistle 91. Pump handle 41 is pivotally supported between bellows 100 and 110 such that the downward pivotal motion described above of pump handle 41 forces pump handle 41 against linking arm 120 producing a compressive downward force which is coupled simultaneously to bellows 100 and 110 by outlets 102 and 112 respectively. Thus, each time pump handle 41 is pivoted downwardly, bellows 100 and 110 are collapsed closing inlet valves 101 and 111 respectively and producing pressurized air streams in tubes 103 and 113 respectively. As mentioned above, the pressurized air streams in tubes 103 and 113 cause ultrasonic whistle 90 and audible whistle 91 to operate and produce their respective acoustic energies. Upon the release of handle 41, the return force of spring 83 restores handle 41 to its raised position shown in FIG. 4. With the release of compressive force against linking arm 120, the resilience of air bellows 100 and 110 causes them to expand vertically to return to the position shown in FIG. 5. During this expansion, inlet valves 101 and 111 are open permitting a fresh supply of air to be drawn into the interior of air bellows 100 and 110 respectively.

Thus, the activation of the present invention sound unit within toy train set 10 produces an exciting audible whistle sound together with an inaudible ultrasonic sound energy. The latter is used to control toy train engine 11 in a simple on/off operation easily understood and operated by a young child. The simultaneous production of both inaudible acoustic control sound energy and audible sounds replicating a train whistle adds to the excitement and play value of the present invention dual sound toy train set. The common mechanical coupling and dual air bellows of the present invention sound unit provide a convenient, easy to manufacture and inexpensive mechanism for producing the simultaneous sounds. The system is simple to operate and may be readily understood and operated by extremely young children.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A dual sound toy comprising:

a track;

a toy vehicle movable on said track having battery-powered propulsion means;

control means responsive to a first inaudible sound frequency within said toy for causing said propulsion means to alternate between operative or inoperative states each time said first sound energy is received; and sound producing means for simultaneously producing sound energy at said first sound frequency and sound energy at a second audible sound frequency.

2. A dual sound toy as set forth in claim 1 wherein said toy vehicle includes a toy train engine and wherein said track defines a train track.

3. A dual sound toy as set forth in claim 2 wherein said first sound frequency is an ultrasound frequency and said second sound frequency imitates a locomotive whistle sound.

4. A dual sound toy as set forth in claim 3 wherein said sound producing means include:

first and second collapsible air bellows for producing first and second air streams when compressed;

an ultrasonic whistle for producing inaudible sounds;

an audible whistle for producing audible train whistle sounds;

means coupling said first air bellows to said ultrasonic whistle;

means coupling said second air bellows to said audible whistle; and handle means for simultaneously compressing said fist and second air bellows.

5. A dual sound toy as set forth in claim 4 wherein said handle means include a pivotably mounted movable handle and a link arm coupled to said first and second air bellows.

6. A dual sound toy as set forth in claim 5 wherein said handle means include a return spring urging said handle away from said link arm.

7. A dual sound toy as set forth in claim 6 wherein said first and second air bellows are supported in a side-by-side arrangement defining a space therebetween and wherein said link arm spans the space therebetween.

8. A dual sound toy as set forth in claim 7 wherein said handle defines a motion path between said first and second air bellows.

9. A dual sound toy train set comprising:

a toy train having a battery-powered propulsion means and an ultrasonic sound energy responsive control system for alternatively propelling and stopping said toy train each time ultrasonic sound energy is received;

a first air bellows and ultrasonic whistle coupled thereto;

a second air bellows and an audible train whistle coupled thereto;

a mechanical coupling arm link secured to said first and second air bellows; and a handle pivotally movable against said arm link to simultaneously compress said first and second air bellows and cause said ultrasonic whistle and said audible train whistle to operate.

10. A dual sound toy train set as set forth in claim 9 having a return spring coupled to said handle urging said handle away from pivotal motion compressing said air bellows.

* * * * *